United States Patent [19]

Mensik

[11] 4,292,983

[45] Oct. 6, 1981

[54] FILTER CARTRIDGE ASSEMBLY

[76] Inventor: John A. Mensik, 124 Creekdale Rd., Walnut Creek, Calif. 94595

[21] Appl. No.: 137,513

[22] Filed: Apr. 4, 1980

[51] Int. Cl.[3] ..... A24F 5/04

[52] U.S. Cl. ..... 131/187; 131/210; 131/339

[58] Field of Search ..... 131/261 R, 261 B, 201, 131/210, 216, 187, 198 R, 10.3, 10 R

[56] References Cited

U.S. PATENT DOCUMENTS

| | | | |
|---|---|---|---|
| 2,954,772 | 10/1960 | Lebert | 131/10.5 |
| 3,313,308 | 4/1967 | Grasso | 131/210 X |
| 3,631,866 | 1/1972 | Bottazzi | 131/210 |
| 3,926,199 | 12/1975 | Thomas | 131/187 |

*Primary Examiner*—Stephen C. Pellegrino
*Attorney, Agent, or Firm*—Ernest M. Anderson

[57] ABSTRACT

A filter cartridge assembly for filtering tars from tobacco smoke is described, said assembly comprising a cylindrical sleeve and an inner filter core member, the inner surface of the cylindrical sleeve and the outer surface of the core member defining a smoke passageway. One end of the sleeve is formed with an obstruction having a restricted inlet passage therethrough, the other end being essentially open for receiving the filter core member therein. A pair of stand-off contacts is provided on one end of the core member, said contacts projecting from an impingement surface, and a cylindrical plug having a restricted outlet passage is formed on the opposite end. When the core member is assembled within the sleeve, the plug end thereof is positioned in sealing relating to the open end of the sleeve and supports the filter core member therefrom. The cross sectional area of the restricted outlet passage is carefully selected to control the flow of smoke through the assembly to control the level of filtration and affect the quality of taste.

4 Claims, 4 Drawing Figures

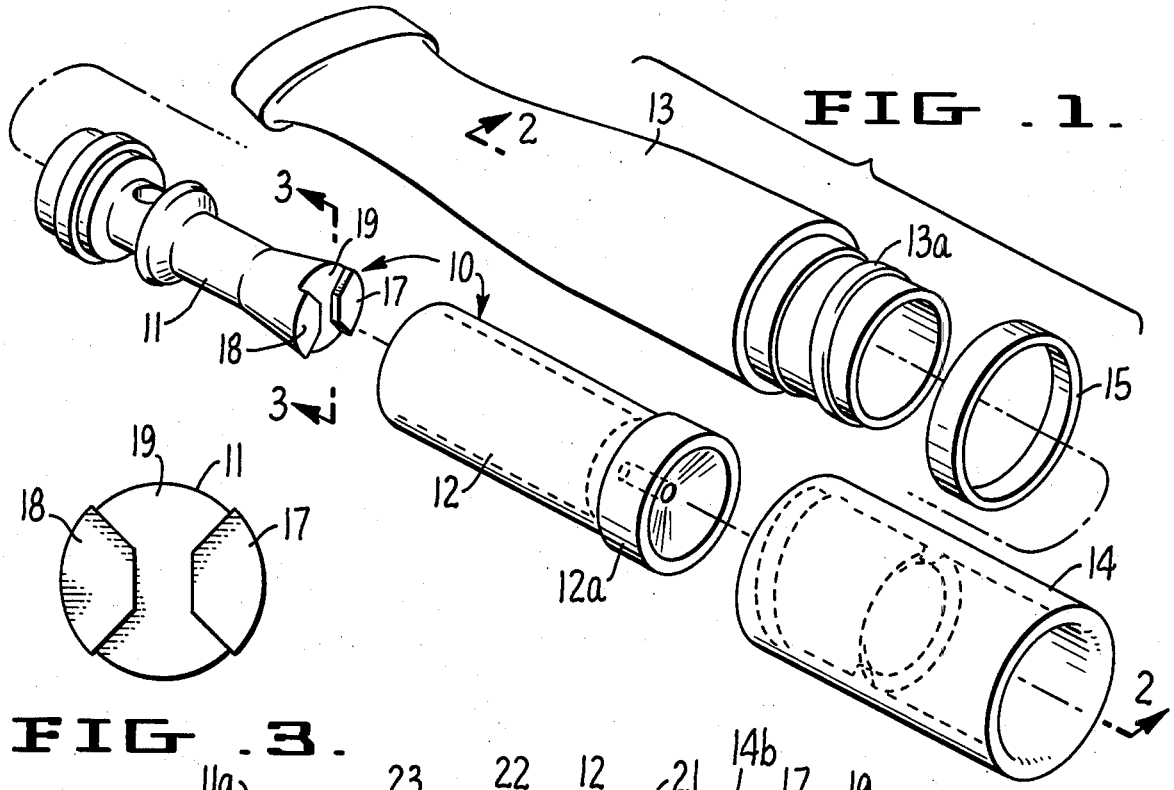
FIG. 1.
FIG. 3.
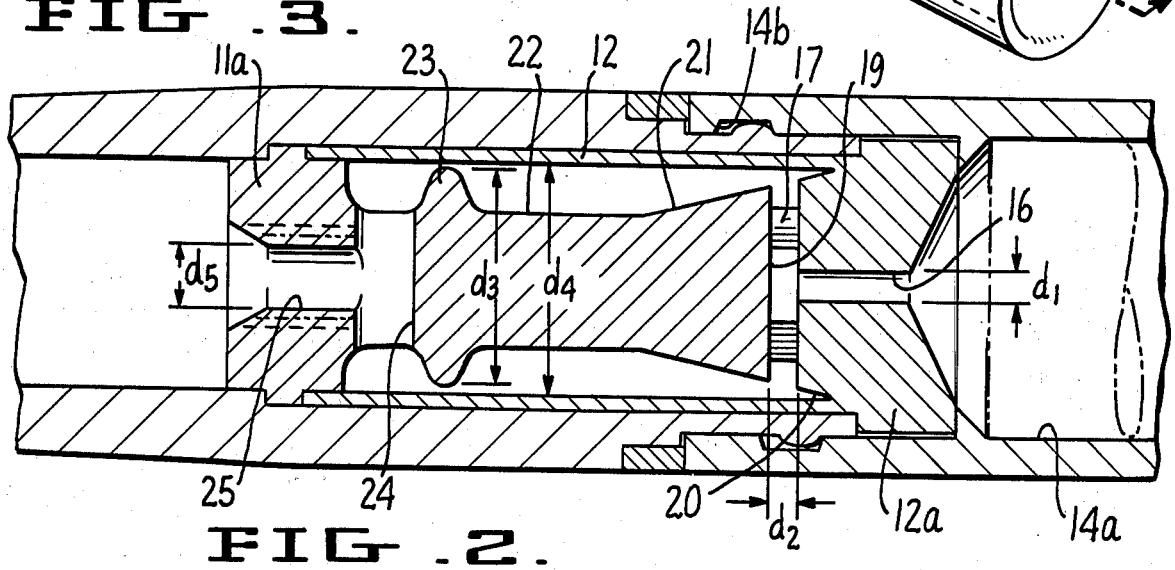
FIG. 2.
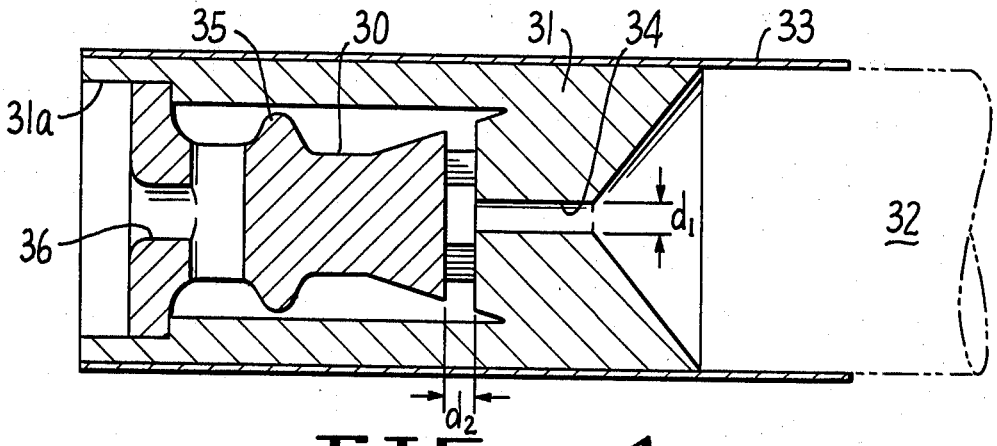
FIG. 4.

FILTER CARTRIDGE ASSEMBLY

SUMMARY OF THE INVENTION

This invention relates generally to filtering apparatus and more particularly to filter cartridges which utilize a venturi to accelerate smoke vapors and an impingement barrier against which the vapors are directed, the heavier vapors (such as tars) being separated from lighter vapors. This principle of filtration is described in various prior art patents including U.S. Pat. Nos. 2,954,779 and 3,604,428.

The present invention differs from the foregoing patents and other known prior art devices in providing a unique arrangement of parts for constructing a filtering cartridge assembly that may be commercially produced both economically and with sufficient accuracy to ensure a high degree of filtration or, alternatively, to control taste.

The filter cartridge assembly of the present invention comprises a cylindrical sleeve and an inner filter core member. One end of the sleeve is formed with an obstruction having a restricted venturi-type inlet passage, the other end being essentially open for receiving the filter core member therethrough. A pair of stand-off contacts are provided on one end of the core member which also defines an impingement surface, and a cylindrical plug having a restricted outlet passage is formed on the opposite end. The cross sectional area of the restricted outlet passage is carefully selected to control filtration and affect taste. When the core member is assembled within the sleeve the stand-off contacts engage the obstruction of the sleeve, positioning the impingement surface directly in front of and in precise, spaced relationship to the end of the venturi inlet passage.

One object of the present invention is to provide a filter cartridge having a novel construction which lends itself to commercial production at a relatively small expense and which may be utilized either in conjunction with a filter holder or as an integral part of a cigarette.

Another object is to provide a novel arrangement for a filter cartridge assembly having a filter core member formed with a pair of stand-off contacts projecting from an impingement surface at one end, said contacts serving to precisely space and align the impingement surface relative to a venturi opening.

Another object of the invention is to provide a filter cartridge assembly of the kind described and wherein the cross sectional area of a restricted outlet passage is selected to control the taste and quality of filtration.

It is a still further object of the invention to provide a filter cartridge assembly of the kind described wherein a conical recess formed peripherally of an impingement surface produces a desirable turbulence of flow aiding in the removal of tars and other objectionable substance which adversely affect taste.

And yet a further object of the invention is to provide a filter cartridge assembly of the kind described that may be utilized in connection with a cigarette holder comprised of a cigarette receptacle, a mouth piece and a spacer ring, said spacer ring denoting by color (or other indication thereon) the particular filtration capability of the cartridge contained therein.

Various other objects of this invention will become apparent in view of the following detailed description.

In the drawings forming apart of this application and in which like parts are identified by like reference numerals throughout the same, FIG. 1 is an exploded view of a filter cartridge assembly and a holder for said cartridge;

FIG. 2 is a longitudinal section of the filter cartridge assembly and a portion of the holder in assembled condition;

FIG. 3 is an end view of the inner core member of the filter cartridge assembly as viewed on line 3—3 of FIG. 1; and FIG. 4 is a longitudinal section of a second embodiment of the invention illustrating a filter cartridge assembly for use as an integral part of a cigarette.

Referring to FIGS. 1, 2 and 3, there is shown a preferred embodiment of a filter cartridge assembly 10 comprising a cylindrical sleeve 11 and a filter core member 12. Cartridge assembly 10 is adapted to be received within a three-part holder assembly consisting of a mouth piece 13, a cigarette holder 14, and a spacer ring 15.

Cylindrical sleeve 12 is formed with an obstruction 12*a* at one end, the other end being essentially open and adapted for receiving filter core member 11 therethrough. A restricted venturi-type inlet passage 16 is formed through obstruction 12*a* coaxially of the sleeve. The size of passage 16 is restricted to increase velocity of smoke drawn from a cigarette mounted in the recess 14*a* of cigarette holder 14. The diameter of passage 16 is indicated by the letter $d_1$, a value which may be the same as or consistent with prior art filter constructions. In a preferred construction $d_1$, may have a dimension 0.029 inches (or 0.737 mm.) giving a cross sectional area of 0.00066 square inches (or 0.426 square mm.).

Core member 11 is dimensionally formed to be received within sleeve 12, a pair of stand-off contacts 17 and 18 being symetrically formed and projecting from an impingement surface 19 at one end. Contacts 17 and 18 engage the inner surface of obstruction 12*a* and space the impingement surface 19 a distance $d_2$ therefrom. (A preferred distance $d_2$ is 0.029 inches or 0.737 mm). It will be noted also that stand-off contacts 17 and 18 are symetrically arranged on opposite sides of the inlet passage 16 allowing the smoke stream which enters therethrough to impinge against surface 19 and move around and to both sides of filter core member 11. A conical recess 20 is formed in obstruction 12*a* of sleeve 12 to produce turbulence in the flow of smoke peripherally of the impingement surface 19. The effect of this turbulence, combined with the high velocity impingement of the smoke stream against surface 19, serves to separate the heavier tar vapors and cause such tar vapors to become deposited on the adjacent surfaces of the core member and sleeve.

The central body portion of core member 11 is of reduced cross section being conically tapered in the region 21 toward a cylindrical center portion 22. However, an annular enlargement 23 provides a dam that restricts the flow of smoke through the filter assembly between sleeve 12 and core 11. The diameter of the annular enlargement is shown as $d_3$, and this dimension bears a relationship to the inside diameter of sleeve 12, which is indicated by the reference $d_4$, to control the flow of smoke and retain tar particles within the assembly.

A transverse passage 24 communicates the interior of sleeve 12 on the downstream side of enlargement 23 with a restricted outlet passage 25 formed through a cylindrical plug 11*a*, which also forms an integral part of the core member. Plug 11*a* sealingly engages the inner surface and end of sleeve 12, thus preventing a bypass of smoke and requiring the smoke to be withdrawn through transverse passage 24 and restricted outlet passage 25.

The diameter $d_5$ of restricted outlet passge 25 is substantially greater than the diameter $d_1$ of restricted inlet passage 16. But passage 25 is also chosen or "sized" to regulate filtration and taste quality. More particularly, it has been found that for best filtration the cross sectional area of outlet passage 25 must be smaller than the passageway between the inner cylindrical surface of sleeve 12 and the annular enlargement 23 of core member 11.

This invention further contemplates, that core member 11 be formed with restricted outlet passages of various sizes. The particular size of the outlet passage determines the effectiveness of filtration without substantially varying the suction force required to smoke a cigarette. In that regard the suction force required is controlled by the most restricted passage which, in connection with the present invention, is venturi inlet passage 16.

It has been found that increasing the size of outlet passage 25 to a cross sectional area greater than that between the annular enlargement 23 and the inner surface of sleeve 12 results in a substantial change in filtration of the filter cartridge assembly. This is best shown by assigning exemplary dimensional values to dimensions $d_3$ and $d_4$ and varying the size of outlet passage 25. If the dimension $d_3$ and $d_4$ are 5.59 and 5.89 mm. respectively, then the flow area between sleeve 12 and enlargement 23 will be 2.705 square mm. It has been determined that using a diameter $d_5$ of 1.676 mm. (which provides a cross sectional flow area of 2.206 square mm.) gives the very best filtration. However, increasing the dimension $d_5$ to 1.930 mm. (and a cross sectional area of 2.925 square mm.) gives only good filtration, and a dimension of 2.184 mm. (and a cross sectional area of 3.746 square mm.) yields very poor filtration.

A comparison of the cross sectional area through the restricted outlet passage 25 for each of the three examples demonstrates the importance of utilizing a restricted outlet passage which is smaller in area than the cross sectional area between the inner surface of sleeve 12 and the annular enlargement 23 for best filtration. However, it may be of commercial value to intentionally make filter assemblies having a poorer filtration quality to control "taste." This is accomplished with the present invention by merely enlarging passage 25 to a cross sectional area equal or greater than the area between sleeve 12 and enlargement 23.

The three-piece holder shown is uniquely constructed to receive filter assembly 10. The end of mouth piece 13 is formed with a thread 13*a* that threadably engages with a groove 14*b* formed in the end of receptacle 14. A peripheral recess 13*b* is provided adjacent to thread 13*a* for receiving spacer ring 15. This ring provides a limit to the threading engagement with receptacle 14, positions the receptacle relative to the mouth piece for proper retention of the filter cartridge assembly 10 and insures proper sealing. Ring 15 may also be used to indicate the filtration capability of the cartridge assembly being used. This can be done by color coding the ring and supplying a new ring with each filter cartridge assembly.

FIG. 4 of the drawing illustrates a second embodiment of a filter cartridge assembly suitable for use as an integral part of a cigarette. The filter assembly comprises a core member 30 and a sleeve 31 mounted to a cigarette 32 by an encapsulating skirt or band 33. Core member 30 and sleeve 31 are formed with all of the same structural features described in connection with the filter assembly 10 of FIGS. 1 through 3. However, the body portion of core member 30 is substantially shorter in length than core member 11 since only a small amount of tars can be removed from a single cigarette. It will be noted that the dimension $d_1$ of venturi inlet passage 34 and the stand-off distance $d_2$ may be the same as the first embodiment. But with the use of a smaller filter assembly the internal circumference of sleeve 30 and the outer periphery of the core enlargement or dam 35 may be made to smaller dimensions. Notwithstanding, it is essential for best filtration that the restricted outlet passage 36 be smaller than the area between the inner surface of the sleeve and the annular enlargement. As an example, the diameter of the outlet passage may be 1.397 mm. (resulting in a cross sectional area of 1.516 square mm.) compared with a throat area between the inner surface of sleeve 31 and the outer surface of enlargement 35 of 2.452 square mm. (where the diameter dimensions defining that throat are 5.309 mm. and 5.004 mm, respectively).

The essential difference between the filter assembly of FIG. 4 and that shown in FIGS. 1 through 3, is that the open end of sleeve 31 provides a recess 31*a* for receiving the cylindrical plug end of filter core 30 in recessed relation to the end of the sleeve. This allows the filter assembly to be used without a separate mouth piece as provided in connection with the first embodiment.

Although preferred embodiments of the invention have been illustrated and described, various modifications and changes may be resorted to without departing from the spirit of the invention of the scope of the appended claims, and each of such modifications and changes is contemplated.

What is claimed is:

1. A filter cartridge assembly for filtering tars from tobacco smoke comprising:

a cylindrical sleeve having an integral obstruction formed at one end, coaxial restricted inlet passage extending through said obstruction; and a filter core member received within said sleeve, said core member being formed with a central body portion including an annular enlargement, a stand-off contact projecting from an impingement surface at one end, and a cylindrical plug having a restricted outlet passage at the other end, the central body portion of said core member and inner surface of said sleeve defining a smoke passageway between the restricted inlet passage and the cylindrical plug, a transverse passage being formed through the central body portion of said core member communicating the restricted outlet passage with the interior of said sleeve on the downstream side of said annular enlargement, said stand-off contact engaging the obstruction within said sleeve and spacing the impingement surface of said core in predetermined spaced relation to the opening of said restricted inlet passage, said cylindrical plug being received within the sleeve in sealing relation thereto and supporting said filter core member therefrom, the cross sectional area of the restricted outlet passage being smaller than the area between the inner surface of said cylindrical sleeve and the annular enlargement of said core member and selected to control the quality of filtration.

2. The filter cartridge assembly of claim 1, a conical recess being formed in the obstruction of said sleeve to produce turbulence in the flow of smoke peripherally of the impingement surface.

3. The filter cartridge assembly of claim 1, the restricted outlet passge of said plug being at least three times greater than the restricted inlet passage through the obstruction of said cylindrical sleeve.

4. A filter cartridge assembly for filtering tars from tobacco smoke comprising:

a cylindrical sleeve having an obstruction formed at one end, a coaxial restricted inlet passage extending through said obstruction;

a filter core member received within said sleeve, said core member being formed with a central body portion including an annular enlargement, a stand-off contact projecting from an impingement surface at one end, and a cylindrical plug having a restricted outlet passage at the other end, the central body portion of said core member and inner surface of said sleeve defining a smoke passageway between the restricted inlet passage and the cylindrical plug, a transverse passage being formed through the central body portion of said core member communicating the restricted outlet passage with the interior of said sleeve on the downstream side of said annular enlargement, said stand-off contact engaging the obstruction within said sleeve and spacing the impingment surface of said core in predetermined spaced relation to the opening of said restricted inlet passage, said cylindrical plug being received within the sleeve in sealing relation thereto and supporting said filter core member therefrom;

and a holder for said filter cartridge, said holder comprising a cigarette receptacle and a mouthpiece threadably and coaxially connectable, said mouthpiece being formed with a peripheral recess, and a spacer ring mountable within the recess of said mouthpiece and engageable with the end said cigarette receptacle when connected to said mouthpiece, said spacer ring providing a limit to threading engagement, axially positioning the receptacle and mouthpiece for incapsulation and proper retention of said filter cartridge assembly and effecting a seal therewith.

* * * * *